United States Patent [19]

Bloomfield

[11] 4,010,845

[45] Mar. 8, 1977

[54] COIN HOLDER

[76] Inventor: Samuel Bloomfield, P.O. Box 4500, Palm Springs, Calif. 92262

[22] Filed: Apr. 28, 1975

[21] Appl. No.: 572,129

[52] U.S. Cl. ..... 206/.82; 206/45.34

[51] Int. Cl.[2] ..... A45C 11/28

[58] Field of Search ..... 206/.8–.84, 206/45.34

[56] References Cited

UNITED STATES PATENTS

| | | | |
|---|---|---|---|
| 3,023,525 | 3/1962 | Cointreau | 206/.82 |
| 3,057,459 | 10/1962 | Burdick | 206/.83 |
| 3,069,001 | 12/1962 | Burdick | 206/.83 |
| 3,155,236 | 11/1964 | Reno | 206/.82 |
| 3,229,809 | 1/1966 | Spadaro | 206/.82 |

*Primary Examiner*—Steven E. Lipman
*Attorney, Agent, or Firm*—Lyon & Lyon

[57] ABSTRACT

Disclosed herein is a device for holding a coin for viewing by collectors which is comprised of a flat supporting plate held between a pair of transparent viewing plates. The supporting plate has an enlarged central viewing aperture therein and carries a plurality of projecting arms which are slidably mounted thereon and extend into the enlarged aperture for holding the coin therebetween to permit viewing of the obverse, reverse and edge of the coin.

6 Claims, 5 Drawing Figures

COIN HOLDER

BACKGROUND OF THE INVENTION

There are currently available numerous different devices for use by numismatists for displaying rare and valuable coins. Such devices range from simple plastic envelopes to plastic containers which securely hold the coin about the edge thereof and allow viewing of the obverse and reverse of the coin, i.e., both sides thereof. The purpose of such holders is to allow a viewer or potential purchaser of the coin to view the coin while minimizing direct handling of the coin, which, if not conducted in the utmost care, can result in inadvertant scratching of the surface thereof and the slightest scratch has a great adverse affect on the value of a coin. Even when a coin is handled with extreme care, this danger is always present, as is the chance that a coin might be tarnished merely from contacting the natural oils in one's hands.

While the coin holders presently available to collectors allow a person to view the obverse and reverse of the coin without actual handling thereof, they do not permit one to view the edge of the coin without removal of the coin from its holder. Typically, the better the protection afforded by the holder, the more difficult is the removal and replacement of the coin from the holder, and consequently, there is a greater chance of damage to the coin with such holders. The condition of the edge of a coin is a very important part of all coins to collectors and particularly so on those coins having a legend therein. With present holders which generally hold the coin about the edge thereof, continued removal of the coin to view the edge necessarily causes deleterious wear on the edge. If, on the other hand, the coin is loosely held, it will rattle about within the holder on the edge thereof, also resulting in edge and rim wear over a period of time. It would be very desirable for numismatists to have a coin holder which would securely hold the coin and protect it from any actual contact with the hands of a viewer or potential purchaser while affording such an individual a clear view of the edge of the coin as well as the obverse and reverse and additionally minimizing the necessary area of contact between the holder and the edge of the coin.

SUMMARY OF THE INVENTION

Briefly, the invention comprises a coin holder having an enlarged central viewing area wherein a coin is firmly held by a plurality of projecting members which are slidably mounted and extend into the viewing area of the holder to engage the edge and rim of the coin at isolated contact points therealong to allow viewing of the rim of the coin as well as the obverse and reverse thereof, without the necessity of removing the coin from the holder.

It is the principal object of the present invention to provide a coin holder which protects the coin from actual contact while exposing the edge, obverse and reverse of the coin to view.

It is another object of the present invention to provide a coin holder which allows one to view the edge of the coin without need to remove the coin from the holder.

It is still another object of the present invention to provide a coin holder which is adaptable for use with coins of varying sizes and configurations.

It is yet another object of the present invention to provide a coin holder which facilitates the insertion of a coin therein to minimize the possibility of damage to the coin during mounting thereof.

It is another object of the invention to provide a coin holder which obviates the need for close tolerances to securely hold a particular coin therein.

It is still another object of the present invention to provide a coin holder which is of simple construction and economical to manufacture.

It is yet another object of the present invention to provide a coin holder which securely holds a coin therein and minimizes the actual area of contact between the holder and the coin.

Other objects and advantages of the present invention will become apparent from the following detailed description taken in conjunction with the accompanying drawings.

IN THE DRAWINGS

Figure 1:
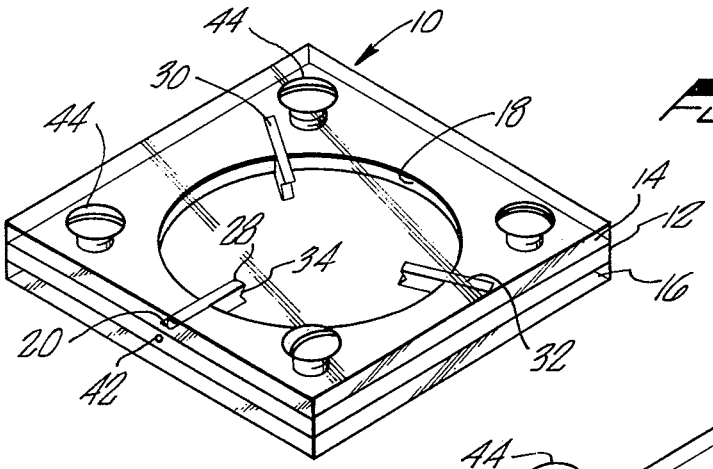
FIG. 1 is a perspective view of the coin holder.
Figure 2:
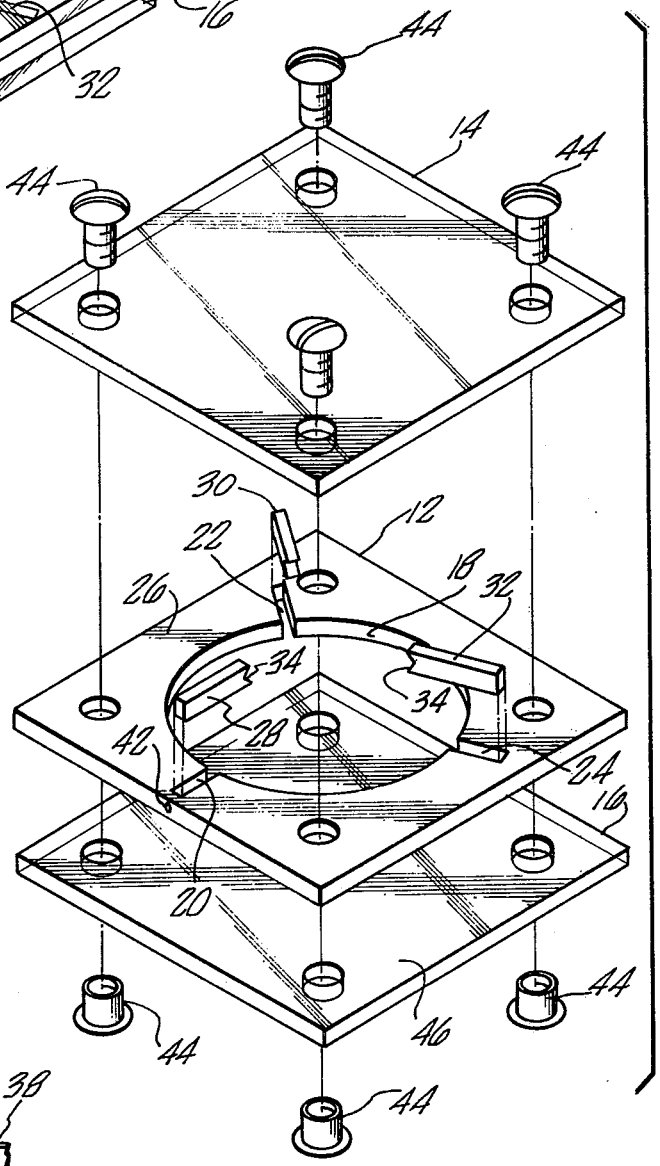
FIG. 2 is an exploded view of the coin holder.
Figure 3:
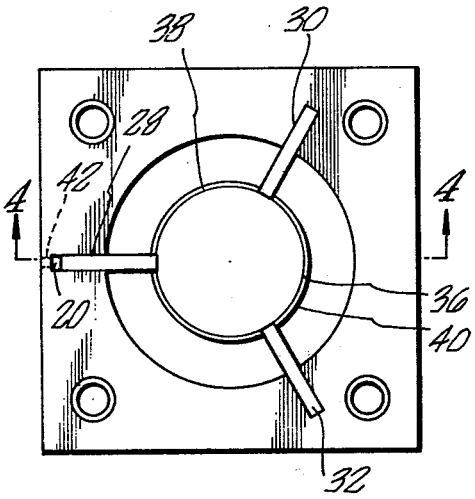
FIG. 3 is a top plan view of the supporting plate showing a coin held therein.
Figure 4:
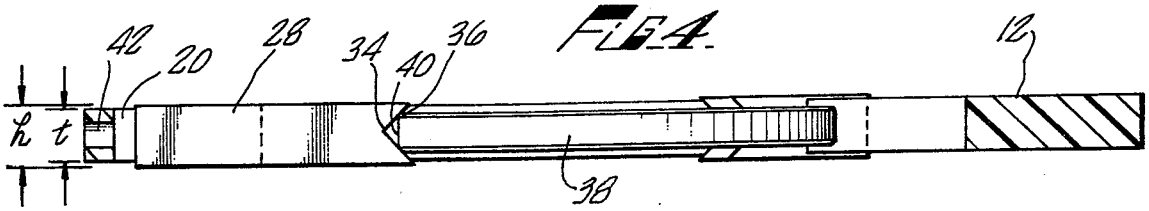
FIG. 4 is an enlarged sectional view taken along line 4—4 in FIG. 3.

Referring now in detail to the drawings, the coin holder 10 is comprised of a flat supporting plate 12, an upper viewing plate 14 and a lower viewing plate 16. The viewing plates are transparent and preferably constructed of a transparent plastic material, while the supporting plate is preferably constructed of an opaque, color tinted plastic material to provide a colored contrast for the coin, although, if desired, the support plate could also be transparent. The support plate 12 has an enlarged central viewing aperture 18 therein and, in the preferred embodiment, three radial slots 20, 22 and 24 which are equiangularly disposed in the upper surface 26 of the plate about and in communication with the viewing aperture 18. Projecting members 28, 30 and 32 are disposed in the radial slots 20, 22 and 24, respectively, each projecting into the viewing aperture 18. Each projecting member defines a prong 34 at its extended end [see FIG. 4] to engage the the extended perimeter portion of the rim 36 of a coin 38. In this manner, any contact between the surface of the edge 40 of the coin on which a legend may appear and the coin holder is minimized. As shown in FIG. 3, slots 22 and 24 are of the same length, while slot 20 is extended with respect thereto. An adjustment aperture 42 is disposed in the side wall of the support plate 12 to communicate with the elongated slot 20. A plurality of standard threaded fastening means 44 are provided in the four corners of the holders to draw the upper and lower view plates tightly about the support plate and projecting members.

To place a coin within the holder 10, the threaded fastening means 44 are removed and the upper viewing plate 14 is lifted from the holder. The projecting member 28 disposed within the elongated slot 20 is urged to the rear of the channel and the coin 38 to be displayed is placed on the upper surface 46 of the lower viewing plate 16 within the viewing aperture 18. The coin is then urged into engagement with the prongs 34 of projecting members 30 and 32. Projecting member 28 which is slidably mounted within the elongated slot 20 is then urged into engagement with the rim or, more accurately, the line of juncture between the rim and edge of the coin. This is easily accomplished, as the height of the projecting members *h* [see FIG. 4] is about 0.002 inch larger than the thickness t of the support plate and so the upper edge of the projecting member can be readily engaged by one's fingernail to slide the projecting member within the elongated slot into contact with the rim of the coin. When the coin is firmly engaged by the prongs of the three projecting members, the upper viewing plate 14 is placed over the support plate and projecting members and secured thereto by the threaded fastening means 44. Because the height of the projecting members is slightly greater than the thickness of the support plate, as the fastening means are tightened about the viewing plates, the projecting portions are firmly held in place within the radial slots, thereby securely holding the coin in place. With the coin holder so secured, the coin can be readily viewed from all angles through the transparent viewing plates. If desired, the projecting members can also be constructed of a transparent plastic material to expose the entire area of the rim and edge of the coin to view.

To increase the flexibility of the holder, projecting members of varying length can be supplied so that the holder can display coins of varying size. Alternatively, the projecting members could be marked at various locations along the body thereof according to the size of standard coins and severed at the corresponding mark whereupon the members would correspond in length to the diameter of the particular coin. For example, a projecting member could have marks corresponding to the silver dollar, half dollar, quarter, nickel, penny and dime. If one wished to mount a quarter within the holder, the projecting members would be severed at the location corresponding to the quarter. The severed projecting members would then be positioned in the respective channels and be of the proper length to hold and display the quarter therein. In addition, the slidable mount of the projecting member 28 within the elongated channel 20 allows the housing to accommodate coins of irregular shape, such as oddities and ancient coins. Should it become necessary at any time to tighten the pressure exerted by the projecting members on the coin, the fastening members need only be loosened and a pin or the like can be inserted through the adjusting aperture 42 to urge the slidable projecting member 28 and prongs carried thereby more firmly against the rim of the coin, thereby obviating the need to remove the upper viewing plate 12 and expose the coin.

Figure 5:
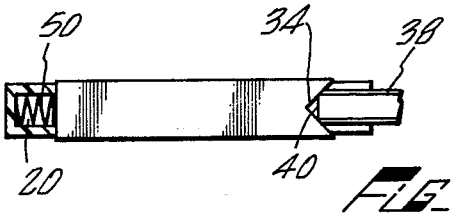
FIG. 5 is a partial view of a second embodiment of the coin holder.

In a second embodiment of the coin holder, shown in FIG. 5, a coil spring 50 is disposed at the rearward end of the elongated channel 20 to continually urge the prongs carried by the projecting member against the rim of the coin. Various other changes and modifications can be made in carrying out the present invention without departing from the spirit and scope thereof. Insofar as these changes and modifications are within the purview of the appended claims, they are to be considered as part of the invention.

I claim:

1. A coin holder comprising a first transparent plate, a second transparent plate, a support plate disposed between said first and second transparent plates, said support plate having a viewing aperture therein and a plurality of slots radially disposed about and communicating with said viewing aperture, a corresponding plurality of elongated coin supporting arms disposed within said slots, at least one of said arms being slidably mounted within one of said slots and each of said arms defining prongs at the innermost extended end thereof for contacting a coin disposed within said viewing aperture at the juncture of the rim and edge portions thereof and having a transverse width substantially less than the longitudinal length thereof for minimizing the visual obstruction of the edge portion of said coin and means for securing said transparent plate about said support plate and supporting arms.

2. The combination of claim 1 including an aperture disposed in one end of said support plate and communicating with the slot therein in which said elongated coin support arm is slidably mounted whereby said supporting arm can be externally urged against a coin disposed within said viewing aperture.

3. The combination of claim 2 including means for biasing said slidably mounted elongated coin supporting arm inwardly of said viewing aperture.

4. The combination of claim 3 wherein said elongated supporting arms disposed in said slots protrude outwardly thereof through a flat plane defined by the surface of said supporting plate such that the supporting arms are engaged by at least one of said transparent plates.

5. The combination of claim 4 including means for biasing said slidably mounted elongated coin supporting arm inwardly of said viewing aperture.

6. The combination of claim 1 wherein said elongated supporting arms disposed in said slots protrude outwardly thereof through a flat plane defined by the surface of said supporting plates such that the supporting arms are engaged by at least one of said transparent plates.

* * * * *